United States Patent [19]

Wang et al.

[11] 4,094,625

[45] June 13, 1978

[54] METHOD AND DEVICE FOR EVAPORATION AND THERMAL OXIDATION OF LIQUID EFFLUENTS

[75] Inventors: Robert Wang, Wissous; Didier Brun, Saint-Cloud, both of France

[73] Assignee: Heurtey Effluthermm, Paris, France

[21] Appl. No.: 657,898

[22] Filed: Feb. 13, 1976

[30] Foreign Application Priority Data

| | | |
|---|---|---|
| Feb. 28, 1975 | France | 75 06303 |
| Jul. 2, 1975 | France | 75 20818 |

[51] Int. Cl.[2] ..... F23M 3/00; F23Q 9/00

[52] U.S. Cl. ..... 431/9; 110/238; 431/284; 110/346

[58] Field of Search ..... 431/4, 8, 9, 174, 175, 431/182, 188, 187, 198, 202, 284; 110/8 C, 8 P, 7 B, 28 B

[56] References Cited

U.S. PATENT DOCUMENTS

| | | | |
|---|---|---|---|
| 1,073,463 | 9/1913 | Banes | 110/28 B |
| 3,050,374 | 8/1962 | Burt et al. | 431/187 X |
| 3,118,493 | 1/1964 | Walstad | 431/183 |
| 3,147,795 | 9/1964 | Livingston et al. | 431/284 X |
| 3,481,680 | 12/1969 | Kohn | 431/9 X |
| 3,787,168 | 1/1974 | Koppang et al. | 431/115 X |
| 3,822,654 | 7/1974 | Ghelfi | 110/7 B X |
| 3,861,857 | 1/1975 | Straitz | 431/202 |

FOREIGN PATENT DOCUMENTS

| | | | |
|---|---|---|---|
| 7,105,233 | 2/1971 | Netherlands | 431/9 |

*Primary Examiner*—Edward G. Favors
*Assistant Examiner*—Larry Jones
*Attorney, Agent, or Firm*—Sughrue, Rothwell, Mion, Zinn and Macpeak

[57] ABSTRACT

Liquid effluents are continously discharged into a reaction chamber and vaporized by a flame formed by a jet of gaseous oxidizer which is impelled in rotational motion and into which is introduced a fluid fuel. The ignited oxidizer-fuel mixture is directed into the chamber inlet in a jet which is spatially distinct from the discharge of liquid effluents. The combustible substances contained in the simultaneously atomized liquid effluents are evaporated and burned by the jet of oxidizer-fuel mixture.

15 Claims, 9 Drawing Figures

FIG. 4
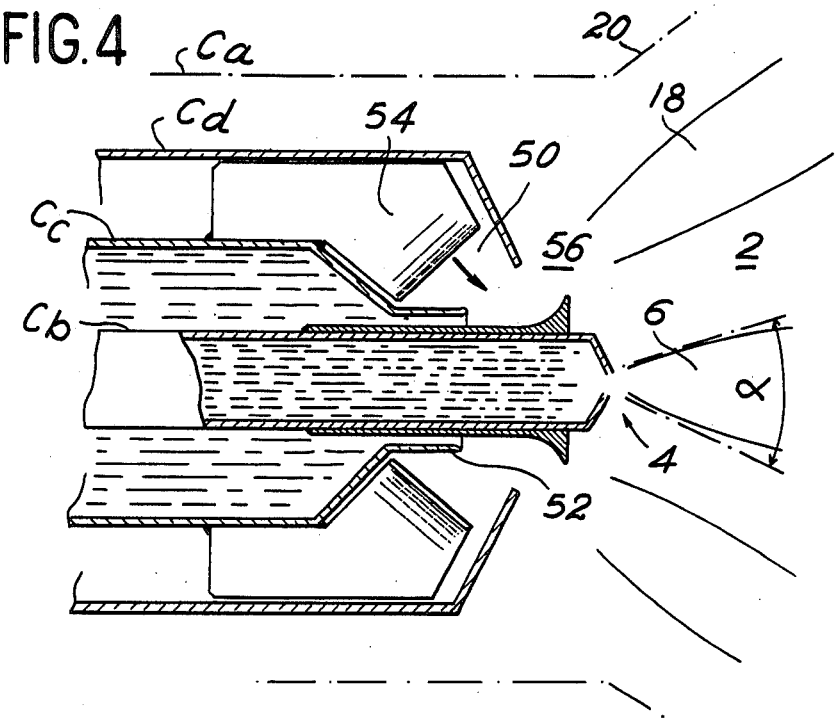
FIG. 2a
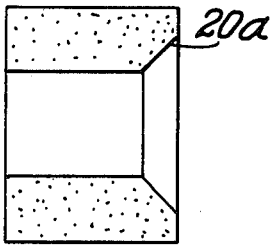
FIG. 2b
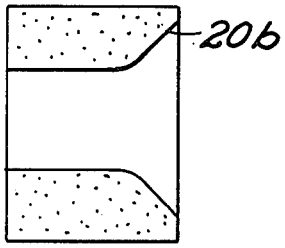
FIG. 3
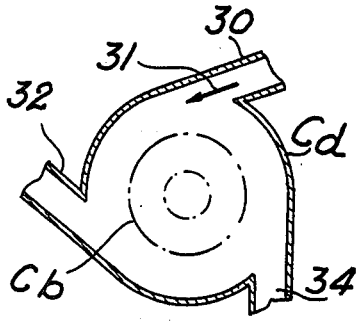
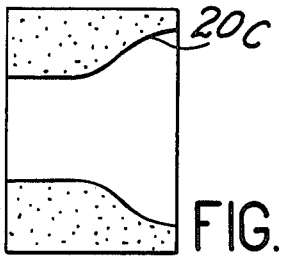
FIG. 2c

METHOD AND DEVICE FOR EVAPORATION AND THERMAL OXIDATION OF LIQUID EFFLUENTS

This invention relates to a method of evaporation and thermal oxidation of liquid effluents containing combustible substances. By means of this method, the effluents can be vaporized and the combustible substances can be heated to a sufficiently high temperature to ensure that these latter are thermally oxidized or in other words burnt and eliminated.

This invention is also concerned with a device for carrying out the method in accordance with the invention.

As is already known, it is often essential to remove toxic pollutants from liquid effluents discharged from many industrial plants such as refineries, paper mills, factories for the chemical conversion of petroleum, for the manufacture of dyestuffs and so forth. When the polluting substances contained in the liquid effluents are in the form of particles of appreciable size, it is possible to separate them by settling or by filtering at a sufficiently high rate to ensure economic performance of these operations and then to burn the collected sludges. However, when the polluting particles are of small size, it has proved necessary to burn these latter by heating the liquid effluents to a high temperature in order to vaporize them and burn the particles contained in said effluents.

One of the techniques of the prior art which is aimed at the destruction of undesirable constituents of liquid effluents involves the preparation of an effluent/fuel oil emulsion. This emulsion is injected into a hot-wall chamber by means of a burner which gives rise to powerful recirculation. In this type of appliance, the supply of heat from the recirculated gases to the spray-discharge jet results in bursting of the fuel-oil drops by the water droplets which are attached to these latter and thus results in extremely fine atomization of the constituents of the emulsion. The heat which is generated by the combustion of the fuel oil and which can also be produced by the combustion of certain inflammable constituents of the liquid effluent serves to vaporize the water and to burn the pollutants contained in the liquid effluent.

This technique is attended by a number of disadvantages in its present form. A first disadvantage lies in the fact that the variations in concentration of liquid effluent of the liquid fuel-oil emulsion is liable to extinguish the burner flame since the effluent is mixed with the fuel oil before this latter is passed into the burner. This potential hazard affects the reliability of the appliance. Moreover, appliances of the prior art do not make it possible to employ the combustible gas in lieu of the fuel oil. It has proved that atomization of the liquid effluent by the fuel gas itself in order to produce an intimate mixture which would have permitted simultaneous combustion and evaporation of the water gives rise in actual fact to a delay in ignition of the gas and general instability of combustion.

Moreover, a certain number of techniques for evaporating and burning liquid or solid effluents consist in making use of injectors for directing fuel mixed with the primary air into a chimney in which is circulated an induced secondary air stream. The same injectors introduce the effluent into the flame of the fuel and of the secondary oxidizer. The presence of air induced at a relatively low velocity is not readily conductive both to accurate adjustment of the combustion and to the intensity of evaporation and burning of effluents. In addition, the injection of effluents into the flame of the fuel is attended by the same disadvantages as in the case of effluent/fuel oil emulsions. These drawbacks are circumvented in the method and the device according to the invention in which a stable flame is obtained with blown secondary air which is employed for atomization of the effluent.

Finally, the methods and devices of conventional type for effluent removal do not make it possible to obtain a ratio of fuel flow rate to fuel + effluent flow rate which is less than 0.2 as in the case of the invention; this ratio serves to measure the efficiency of the system.

The present invention makes it possible both in its method and in its device to overcome these disadvantages by introducing into a chamber a fuel in gaseous or liquid form but preferentially gaseous which is mixed with oxidizer (air for example) within an enclosed space which is separate from the space occupied by a jet of effluents which is atomized at the chamber inlet at the same time. In the method according to the invention, the introduction of the flame into the chamber and the introduction of effluents are separated at the burner inlet; heat exchanges take place between the flame and the atomized liquid effluents only within the vaporization and combustion chamber.

More precisely, the method in accordance with the invention consists in imparting rotational flow motion to a jet of gaseous oxidizer, in then introducing a fluid fuel into the jet of said oxidizer, in introducing the ignited oxidizer-fuel mixture into a chamber in the form of a jet which is geometrically distinct in the vicinity of the chamber inlet from a jet of liquid effluents which are atomized within said chamber at the same time, in evaporating and burning the combustible substances of said liquid effluents by means of the jet of ignited mixture.

As will be explained in the following description, any air which is employed as oxidizer is either the air which is set in rotational flow motion and mixed with the fuel or the air which may be employed for atomizing the liquid effluents at the inlet of the combustion chamber.

The device in accordance with the invention comprises all the means for carrying out the method, two characteristic elements of the device being the use of means for imparting rotational flow motion to the gaseous oxidizer (air or oxygen-enriched air) and the use of an admission element of divergent shape at the chamber inlet so as to separate the jets consisting of ignited fuel-oxidizer mixtures and of liquid effluents.

Although applying in a preferential mode of the invention to gaseous fuels, both the method and the device can also be employed with a liquid fuel. In this case, it is necessary to atomize said liquid fuel before mixing this latter with the gaseous oxidizer in order to form an inflammable mixture at the chamber inlet.

It has also been observed that, in order to carry out the removal of solid wastes, these latter could be converted to a powdered form and also burnt in the combustion chamber. The combustion of these solid elements in the form of powder takes place within the device in accordance with the invention while retaining the main advantages and characteristics of the method, that is, the setting of the oxidizing fluid in rotational flow motion, the geometrical separation at the chamber inlet of the ignited mixture and of the atomized liquid effluent, and the absence of auxiliary air. In order to burn solid wastes in powdered form (having a small particle size which is preferably less than 1 mm), the powdered wastes are introduced either into the oxidizer or into the fuel or even into the liquid effluent.

Preferentially, the solid effluents in powdered form are introduced into the oxidizer either downstream or upstream of the unit employed for imparting rotational flow motion to said oxidizer.

Said solid substances can also be passed into the fuel : by pneumatic injection or by discharge into the gaseous fuel and by mixing with the liquid fuel.

The method can be carried out more readily when the solid wastes such as ground plastic materials, fine particles of rubber and even coal have a high heat-generating power and serve to maintain the flame. The solid wastes must have a small particle size on the one hand in order to ensure rapid combustion and on the other hand in order to be readily transported either in the gas or in the liquid with which they are mixed.

Further properties and advantages of the invention will become apparent from the following description of exemplified embodiments which are given by way of explanation and not in any limiting sense, reference being made to the accompanying drawings, wherein :

FIG. 1 is a diagram of the device for the introduction of a fuel-oxidizer mixture and of liquid effluents at the inlet of a vaporization and combustion chamber;

FIGS. 2*a*, 2*b* and 2*c* show different forms of the divergent structure of the admission element of the vaporization and combustion chamber;

FIG. 3 shows an alternative arrangement for the introduction and initiation of rotational flow motion of the oxidizer prior to ignition;

FIG. 4 is a view to a larger scale showing a constructional detail of the chamber inlet in the event that the fuel mixture is in the liquid state;

Figure 1:
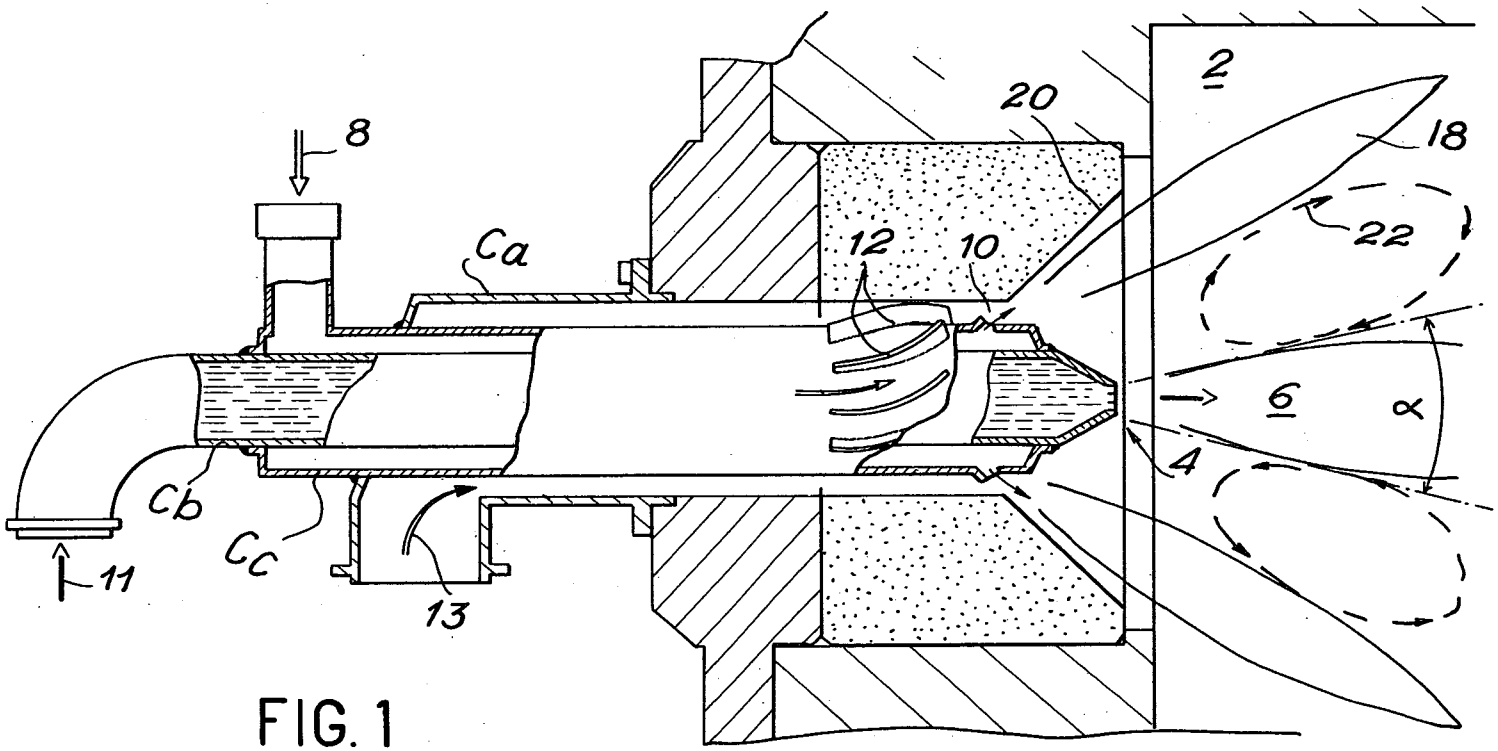

There is shown in FIG. 1 a device for the separate introduction of effluents and ignited mixtures into a reaction chamber 2 in which the effluents are vaporized and in which the combustile substances are burnt. This device comprises a central duct C*b* containing the liquid effluent which is introduced in the direction of the arrow 11 and discharged in spray form at the outlet of the passageway at 4 so as to produce an atomized jet 6 of liquid effluents. An annular duct C*c* surrounds the duct C*b* and is supplied with gaseous fuel which is introduced in the direction of the arrow 8. The duct C*b* is pierced by orifices such as those designated by the reference numeral 10, said orifices being intended to open into the duct C*a* which surrounds the duct C*c*. The duct C*a* is adjacent to the annular duct C*c* and is supplied by means of a device of conventional type not shown in the figure with oxidizer which usually consists of air and circulates at the inlet in the direction of the arrow 13.

An impeller 12 serves to impart rotational flow motion to the oxidizer under the influence of its kinetic energy prior to introduction of the fuel mixture through the orifices such as the orifice 10; the flame shown at 18 results from ignition of the oxidizers-fuel mixture and follows the divergent structure of the admission element 20 of the chamber 2 so as to be spatially distinct from the jet 6 of liquid effluents. In this device, the fuel, oxidizer and liquid effluent are introduced simultaneously through the ducts C*c*, C*a* and C*b* respectively. Within the interior of the chamber, the heat supplied by the flame 18 heats the liquid effluent by means of convection currents represented by the dashed line 22. This convective heat transfer is greatly assisted by the rotational motion imparted to the impeller 12 combined with the divergent structure of the admission element 20. As a result of this turbulent flow motion within the chamber, heat exchange processes between the atomized jet 6 of liquid effluents and the flame 18 are promoted to an appreciable degree. In this device, the combustion of the gas which supplies heat to the chamber is made independent of the atomization of the effluent. The combustion then has remarkable stability and the flame is sufficiently stable after ignition to dispense with the need for a pilot burner. Recirculation of gas within the chamber is the essential factor in the process of evaporation of water and thermal oxidation of the effluents.

In FIG. 1, the setting of the oxidizer in rotational flow motion by means of the impeller 12 precedes the introduction of fuel via the duct C*c*. This is a preferential embodiment of the invention but it is readily apparent that the fuel can just as easily be introduced prior to initiation of rotational flow motion of the oxidizer, in which case the fuel-oxidizer mixture would be set in rotational motion before being introduced into the chamber through the admission element 20. For reasons of safety as well as problems related to fouling of the impeller, it is preferable as shown in FIG. 1 to initiate rotational flow motion of the oxidizer before introducing the fuel.

Atomization or spray discharge of the liquid effluent through the extremity 4 of the duct C*b* can be carried out in different ways which are conventional in themselves. It is either possible to pressurize the liquid contained in the duct C*b*, thus resulting in atomization of the liquid by means of the small orifices in the extremity 4 of the duct C*b* or to make use of pneumatic atomization; in this case, a gas such as air is introduced into the duct C*b* by means of a device which is not illustrated, thus permitting atomization with a higher degree of flexibility by employing lower pressures of injection of gas and liquid. The system of pneumatic atomization which constitutes a preferential method of application of the invention entails the use of air at low or medium pressure (of the order of one half-atmosphere with respect to atmospheric pressure).

FIGS. 2*a*, 2*b* and 2*c* show different forms of construction of the admission element 20. Said element can have the structure 20*a* which is illustrated in FIG. 2*a* or in other words a rectilinear frusto-conical shape or else the shape 20*b* shown in FIG. 2*b* or alternatively the shape 20*c* which is illustrated in FIG. 2*c*.

FIG. 3 shows a sectional view of a portion of an alternative form of construction of the device for the introduction of oxidizer. In this alternative form, the oxidizer is set in rotational flow motion within the duct C*a*, not by means of an impeller such as the unit 12 shown in the embodiment of FIG. 1 but by means of tangential ducts 30, 32 and 34 for the admission of oxidizer. The supply of fluid by tangential introduction makes it possible to carry out two functions at the same time : to introduce the oxidizer and to impart a vortical flow motion to this latter within the duct *Ca*.

There is shown in FIG. 4 a device for the application of the invention which is especially adapted to the use of liquid fuel such as fuel oil. In addition to the ducts *Ca*, *Cb* and *Cc* as in the embodiment shown in FIG. 1, the device in accordance with the invention comprises an additional duct *Cd* in the event that the annular duct *Cc* is supplied with liquid fuel. Said duct *Cd* serves to deliver a jet of gas in the direction of the arrow 50 in the vicinity of the orifice 52 of the duct *Cc*. The duct *Cd* is supplied with gas under pressure (compressed air, for example) and is also fitted in the vicinity of its outlet with an impeller which is provided with vanes 54 which serve to impart rotational motion to the gas for atomizing the liquid fuel contained in the duct *Cc* at the outlet 52. It is readily apparent that said impeller is mentioned solely by way of constructional example. It would be possible to employ any means for imparting rotational flow motion to the gas as this latter is discharged from the duct *Cd*, for example by means of tangential slots, grooves or orifices for the admission of ordinary gas. The flame 18 is produced by the mixture of oxidizer which is introduced through the duct *Ca* and set in rotation by means of an impeller such as 12 (not shown in this figure but identical with the system shown in FIG. 1) and of atomized fuel which comes from the zone 56. Exactly as in the case of FIG. 1, the ignition of the fuel-oxidizer mixture takes place near the base of the conical portion of the admission element 20 which is consequently heated to a high temperature, thus ensuring stabilization and adhesion of the flame even in the absence of a pilot burner. Combustion still continues to take place outside the admission element along the walls of the chamber 2.

The angle $\alpha$ of divergence of the jet 6 of atomized effluents and the exact position of the injection structure comprising the ducts *Ca*, *Cb*, *Cc* are a function of the shape of the admission element. In this case of a gaseous fuel, the angle of divergence $\alpha$ of the jet is within the range of 20° to 45° and the angle of divergence of the admission element is between 45° and 80°. In the case of a liquid fuel, it is an advantage to reduce the angle $\alpha$ of injection of liquid effluent.

The fuel in liquid form can be fuel oil, toluene, ethanol and so forth and in the gaseous form of the natural gas. By means of the device in accordance with the invention, it has been possible to evaporate and burn totally the organic substances contained in 3.5 l of water with 1 $m^3$ of natural gas; by injecting about 8 l of water through the duct *Cb*, all the organic substances contained in the water are not burnt but the flame is not extinguished. The temperature within the chamber is of the order of 850° to 950° C.

It is readily apparent that any mixture of liquid fuel and gaseous fuel can be employed by means of the device in accordance with the invention. As already mentioned, the main original feature of said device is the separate injection of the fuel and of the effluent into the burner. Powerful initiation of rotational flow motion of the oxidizing gas associated with the divergent shape of the admission element of the burner makes it possible to obtain a conical flame which adheres to said admission element and to the chamber walls.

The following table provides three examples which show the operating parameters of the device in accordance with the invention.

| Example No | | 1 | 2 | 3 |
|---|---|---|---|---|
| | Thermal power (kcal/kg) | 9,200 | 9,600 | 9,800 |
| FUEL: Type | | Natural gas | Fuel oil | Solvent |
| | Flow rate (kg/hr) | 1,240 | 285 | 280 |
| | Thermal power (kcal/kg) | 0 | 0 | 600 |
| EFFLUENT: Type | | Phenolated water | Sewage water | Sewage water |
| | Flow rate (kg/hr) | 5,500 | 1,600 | 2,600 |
| RATIO | $\frac{\text{Fuel flow rate}}{\text{(Fuel + effluent) flow rate}}$ | 0.18 | 0.15 | 0.10 |
| RATIO | $\frac{\text{Atomization air}}{\text{Air (atomiz. + combustion)}}$ | 0.095 | 0.125 | 0.20 |

The term "atomization air" designates the primary air (which is directed into the effluent atomizer) and the term "combustion air" designates the secondary air which is mixed with the fuel.

Figure 5:
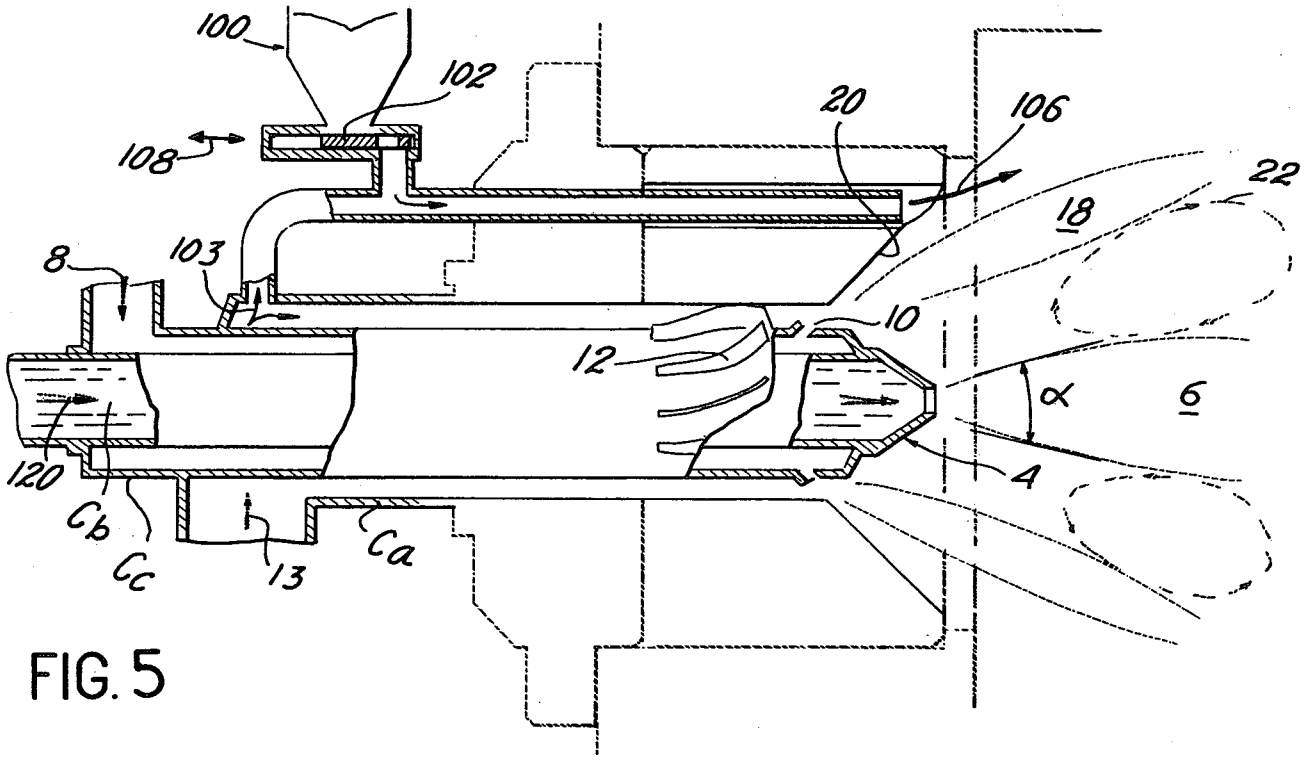
FIG. 5 is a diagram of the device according to one embodiment of the invention in which the solid effluents are passed directly into the flame by means of an inlet pipe branched on the duct Ca for the introduction of oxidizer.

FIG. 5 shows one embodiment of the invention which includes the removal of solid wastes. The reference numerals which are the same as those of FIG. 1 illustrate the same elements. Essentially, the device shown in FIG. 5 comprises three concentric tubes, namely the ducts *Ca*, *Cb* and *Cc*. The gaseous oxidizer is admitted through the duct *Ca* whereas the fluid fuel (liquid or gaseous) circulates within the duct *Cc*, the liquid effluents being directed into the duct *Cb*. At the outlet of the duct *Cb*, the liquid effluents are atomized so as to form a jet having an angle of divergence $\alpha$ whereas, on the downstream side of the orifices 10, the fuel and the oxidizer are mixed, are then ignited and produce the flame 18. By virtue of the shape of the admission element 20 and the rotational flow motion imparted to the gas by the impeller 12, the liquid effluent jet 6 and the flame 18 are geometrically separated from each other at the combustion chamber inlet. In the embodiment shown in FIG. 5, the solid effluents contained in the hopper 100 are introduced at regular intervals into an inlet branch pipe of the duct *Ca* or in other words into the oxidizer through the distributor 102, the movement of which is represented by the arrow 108, said solid effluents being projected into the flame 18 in the direction of the arrow 106 whilst the liquid effluents continue to be supplied through the duct *Cb* and are fed into the same chamber through the orifice 4. The device shown in FIG. 5 is so arranged as to ensure that the oxidizer under pressure (air for example) which is admitted in the direction of the arrows 13 and 103 into the duct *Ca* projects the powdered materials into the flame in the direction of the arrow 106. In this embodiment, the gaseous oxidizer under pressure (air) is employed for atomizing the solid powdered products.

It is readily apparent that, in the embodiment in which the solid substances in powdered form are introduced into the oxidizer, said solid substances can be discharged into the admission element 20 through a plurality of parallel ducts *Ca* or in an annular duct, in which case the powders to be burnt are projected in a cylinder which is generated by the rotation of the arrow 106 about the axis of the duct *Cb*.

In another embodiment which is also illustrated in FIG. 5, the solid effluents are introduced in the direction of the arrow 120 (by means of a device which is not illustrated) into the duct *Cb* in which the liquid effluents are circulated. Should it be desired to burn mainly solid substances, it will be an advantage to employ liquid effluents having high combustion power such as an alcohol, for example.

Figure 6:
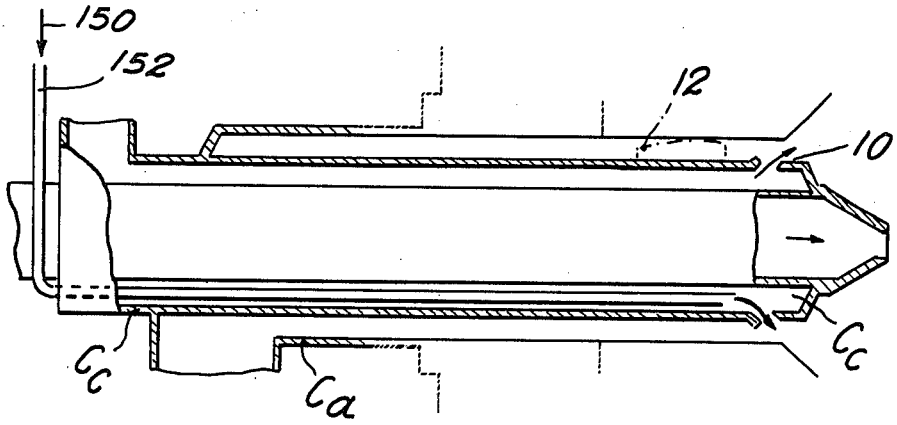
FIG. 6 is a diagram of one embodiment of the invention in which the solid products are introduced into the fuel through the duct Cc.

There is shown in FIG. 6 another embodiment of the invention in which the solid substances introduced at 150 into the duct 152 are directed into the duct *Cc* preferentially in this case of figure in the vicinity of the orifice 10 at which said duct opens into the duct *Ca*.

Figure 7:
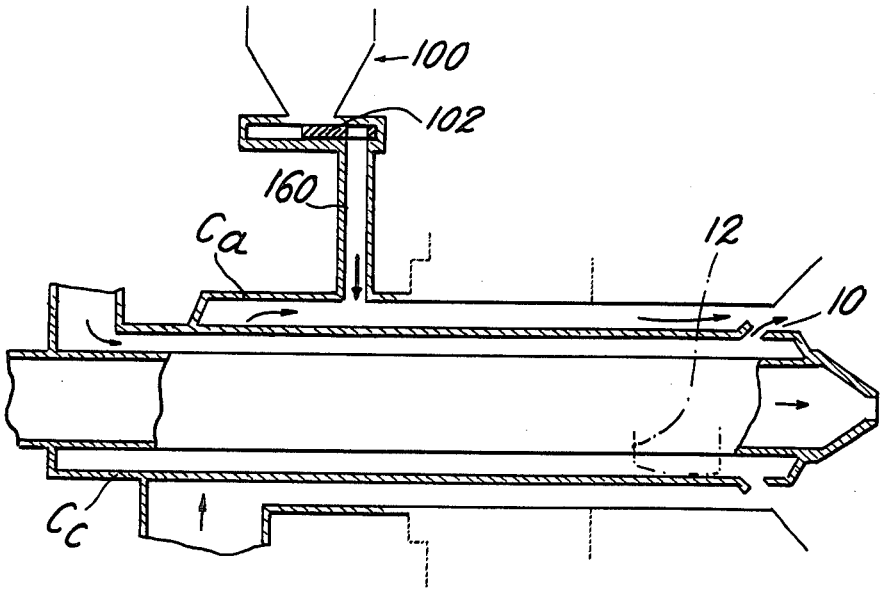
FIG. 7 shows an embodiment of the invention in which the powdered solid products are introduced into the duct Ca prior to initiation of rotational flow motion of the oxidizer by the impeller.

FIG. 7 shows another embodiment in which the solid particles contained in the hopper 100 associated with the distributor 102 are introduced through the duct 160 into the duct *Ca* in which the oxidizer is circulated, this introduction being carried out prior to setting of the oxidizer in rotational flow motion by the rotary impeller 12. The remainder of the device is identical with that shown in FIG. 5.

It is self-evident that many other means can be devised for introducing powders or solid effluents in association with the device in accordance with the invention without thereby departing from the scope of this latter. Similarly, it would be possible to introduce solid substances simultaneously in a number of ducts *Ca, Cb, Cc,* depending on the nature of these substances, especially on their heat-generating power and the potential hazard of clogging of a certain number of ducts.

What we claim is:

1. A method of evaporation and thermal oxidation of liquid effluents in which said effluents are continuously vaporized by a flame, comprising rotating a jet of gaseous oxidizer, introducing a fluid fuel into the jet of oxidizer, igniting and introducing the oxidizer-fuel mixture into a chamber in a rotating outwardly diversing annular jet and introducing a jet of atomized liquid effluent into said chamber with said jet of atomized liquid effluent being concentric to and geometrically distinct in the vicinity of the chamber inlet from the rotating jet of oxidizer-fuel mixture whereby the combustible substances of said liquid effluents are evaporated and burned by the jet of ignited mixture within the chamber.

2. A method as set forth in claim 1 further comprising additionally introducing combustible solid wastes in powdered form into the oxidizer.

3. A method according to claim 1 further comprising additionally introducing combustible solid wastes in powdered form into said liquid effluents.

4. A method as set forth in claim 1 further comprising additionally introducing combustible solid wastes in powdered form directly into said chamber.

5. A method as set forth in claim 1 wherein thermal oxidation is maintained and wherein the ratio between the flow rate of fuel and the flow rate of fuel plus liquid effluents is maintained lower than 0.2.

6. A device for the evaporation and thermal oxidation of liquid effluents comprising a combustion chamber, a first duct having an atomizer for directing a jet of atomized effluents into a vaporization and combustion chamber, a second duct having means for imparting rotational flow motion to an oxidizing gas within said second duct and a third duct for supplying a fluid fuel and means for directing a jet of fluid fuel from said third duct into the oxidizing gas in said second duct in the vicinity of the chamber inlet so that the ignited fuel-oxidizer mixture will pass into said chamber; said chamber inlet having a divergent configuration.

7. A device according to claim 6 wherein said third duct is an annular duct which surrounds said first duct, said third duct being provided with orifices on the wall thereof having the large diameter with said orifices being in communication with said second duct which is an annular duct surrounding said third duct.

8. A device as set forth in claim 6 further comprising means for atomizing a liquid fuel at the outlet of said third duct.

9. A device as set forth in claim 8 wherein the means for atomizing a liquid fuel comprises a fourth annular duct which is disposed between said second and third ducts and provide at the outlet thereof, means for imparting rotational flow motion to a compressed gas adapted to be contained within said fourth duct, said fourth duct having an opening in the vicinity of the orifices of said third duct whereby the compressed gas will atomize the liquid fuel and direct atomized fuel into the flow of oxidizer from said second duct.

10. A device as set forth in claim 9 wherein said means for imparting rotational flow to the compressed gas contained in said fourth duct is comprised of an impeller driven by the compressed air flowing in said fourth duct.

11. A device as set forth in claim 6 further comprising means for introducing combustible solid wastes in powdered form into said second duct in which the oxidizing gas is circulated.

12. A device as set forth in claim 11 wherein said means for introducing solid wastes are placed upstream of the means for imparting rotational flow motion to the oxidizing gas within the second duct.

13. A device as set forth in claim 11 wherein said means for introducing solid wastes are placed downstream of the means for imparting rotational flow motion to the oxidizing gas within said second duct.

14. A device as set forth in claim 11 wherein said means for introducing the solid wastes are placed downstream of the introduction of fuel into the oxidizing gas for direct injection of said solid wastes into the flame.

15. A device as set forth in claim 11 further comprising means for introducing solid wastes in powdered form into said third duct in which the fuel is supplied.

* * * * *